United States Patent [19]

Brown

[11] 4,279,645

[45] Jul. 21, 1981

[54] HEAT RESISTANT ALLOY AND METHOD OF MANUFACTURE

[76] Inventor: Roger K. Brown, 16300 N. Park Dr., Apt. 1011, Southfield, Mich. 48075

[21] Appl. No.: 12,082

[22] Filed: Feb. 14, 1979

Related U.S. Application Data

[63] Continuation-in-part of Ser. No. 897,629, Apr. 19, 1978, abandoned.

[51] Int. Cl.[3] ..... C22C 19/05

[52] U.S. Cl. ..... 75/122; 75/134 F; 75/171

[58] Field of Search ..... 75/171, 170, 134 F, 75/122; 148/32, 32.5

[56] References Cited

U.S. PATENT DOCUMENTS 4,108,647 8/1978 Shaw ..... 75/171

*Primary Examiner*—R. Dean

*Attorney, Agent, or Firm*—Reising, Ethington, Barnard, Perry & Brooks

[57] ABSTRACT

In accordance with the invention there is provided an alloy having high hardness and wear resistance even at elevated temperatures, the alloy consisting essentially of from about 35% to 65% nickel, 15% to 25% chromium, 5% to 20% cobalt, 2% to 5% molybdenum, 1.5% to 4% titanium, 1% to 12% iron, 0.5% to 2% aluminum, 0.3% to 2% silicon, 0.7% to 2% carbon and 1% to 4% boron.

2 Claims, No Drawings

HEAT RESISTANT ALLOY AND METHOD OF MANUFACTURE

CROSS REFERENCE TO RELATED APPLICATION

This application is a continuation-in-part of U.S. patent application Ser. No. 897,629 filed Apr. 19, 1978, abandoned.

TECHNICAL FIELD

The subject matter of the present invention is a high heat resistant alloy, and method for manufacturing same, such alloy being particularly characterized by high hardness and wear resistance even at elevated temperatures.

BACKGROUND ART

Particularly since the advent of aircraft gas turbine engines in the 1940's, a great amount of fruitful work has been done in the development of high temperature resistant alloys for use as components in such engines. To qualify for such use, an alloy must have a combination of a number of outstanding physical properties, one essential property being that of extremely high tensile strength at the elevated temperatures at which such gas turbine engines operate.

One group of alloys which has come into prominent use for such gas turbine engine components is that consisting of the nickel base alloys which additionally contain substantial amounts of chromium and cobalt and lesser amounts of other metals, particularly molybdenum, titanium, and aluminum. A typical such alloy would be one containing approximately 19% chromium, 14% cobalt, 4% molybdenum, 3% titanium, 1% aluminum, 1% iron, and the remainder substantially all nickel.

As is true for all alloys used as aircraft engine components, the specifications for such nickel are quite stringent. This, of course, adds to the cost of manufacturing the virgin alloy. Inherent to the manufacture of the engine components from the alloy stock, as by casting, machining and grinding operations, is the generation of scrap in the form of clean and contaminated metal turnings, grindings, casting scrap and the like. It has heretofore been the practice to remelt such scrap for reuse in making stock from which the turbine engine components are manufactured. However, where the scrap is contaminated or not readily sortable this is impractical and even where the scrap is clean and sortable it involves considerable expense since the stock which is made from or which includes the remelted scrap must, of course, meet the same stringent specifications as must be met by stock made entirely of virgin alloy. Included in the stringent specifications is the requirement for extremely high tensile strength, this characteristic being mandatory for aircraft engine components for obvious reasons.

DISCLOSURE OF THE INVENTION

In accordance with the present invention, the scrap of nickel base alloy formulated to provide high tensile strength even at elevated temperatures is converted efficiently and at relatively low cost into another alloy for a different market end use, in which market the new alloy is highly competitive from a price standpoint and excels from a performance standpoint. More specifically, in accordance with the present invention, additions are made to the remelted nickel base alloy scrap which converts it to an alloy which, though having lesser tensile strength, has extremely high hardness and wear resistance even at elevated temperatures. The essential additions are boron in an amount to provide the alloy with a boron content of from about 1% to 4%, carbon in an amount to provide the alloy with a carbon content of from about 0.7% to 2%, silicon in an amount to provide the alloy with a silicon content of from about 0.3% to 2%, and such other additions as to provide an alloy consisting essentially of from about 35% to 65% nickel (percentages are herein always by weight), 15% to 25% chromium, 5% to 20% cobalt, 2% to 5% molybdenum, 0.5% to 2% aluminum, 1% to 12% iron, 1.5% to 4% titanium, along with the boron, carbon and silicon as aforesaid. Additionally, the alloys can but need not contain small amounts, but preferably not more than about 10% in the aggregate, of other metals such as tungsten, manganese, columbium, vanadium, tantalum, copper and zirconium. Hence, for example, if the alloy of the present invention is made from scrap nickel base alloy having too low a cobalt content, scrap cobalt base alloy can be added to increase the cobalt content, albeit the addition results in the inclusion of such other metals in small amounts.

BEST MODE FOR CARRYING OUT THE INVENTION

As has been alluded to above, the alloys of the present invention can be manufactured and preferably are manufactured using nickel-chromium-cobalt alloy scrap as a starting material. The following example will serve to illustrate.

In this particular example the starting material consists of scrap alloy, e.g. turnings from machining operations, containing 19.5% chromium, 13.5% cobalt, 4.3% molybdenum, 1.4% aluminum, 3% titanium, 0.5% manganese, 0.2% silicon, 0.07% carbon, 1% iron and the remainder substantially all nickel. The scrap is first processed by conventional techniques to remove all contaminants such as oil, grit, and the like. The cleaned scrap is then heated to its melting temperature which, for this particular scrap is about 2500° F. To this molten alloy is added boron in an amount to provide the alloy with a boron content of 1.5%, carbon in an amount to provide the alloy with a carbon content of 0.8%, and silicon in an amount to provide the alloy with a silicon content of 1%. Thereafter the alloy is poured into molds or cast to provide ingots or other stock of the shape desired.

Because the alloys of the present invention have extremely high hardness and wear, abrasion, erosion, and anti-galling resistance in the rotary, reciprocating and oscillatory modes—in combination with extremely high temperature resistance and other excellent characteristics—they are very useful for a variety of products which are required to operate at high temperature and where high hardness and wear resistance along with good tensile strength are mandatory. Examples of such products are cutting teeth used on high speed rock cutting tools and nose rings for calcining kilns. The alloys of the present invention respond favorably to the solution treatment.

It should be pointed out that whereas the alloys of the present invention do not have as high a tensile strength as the alloys from which they are made, nevertheless, the alloys of this invention do have a tensile strength more than ample to meet the requirements of such products, and this is coupled with the high hardness and wear resistance essential to such products.

Hence, by way of and in accordance with the present invention, scrap of alloys formulated to provide exceptionally high tensile strength is rendered more valuable, for use in a variety of end products in demand, by conversion of the alloy to one having lesser tensile strength but increased hardness and wear resistance. By such diversion of the scrap alloy from the purpose for which the alloy was formulated, there is enhanced efficiency, savings, and value.

It will be understood that while the invention has been described with reference to certain embodiments thereof, various changes and modifications may be made all within the full and intended scope of the claims which follow.

What is claimed is:

1. An alloy consisting essentially of from about 35% to 65% nickel, 15% to 25% chromium, 5% to 20% cobalt, 2% to 5% molybdenum, 1.5% to 4% titanium, 1% to 12% iron, 0.5% to 2% aluminum, 0.3% to 2% silicon, 0.7% to 2% carbon, and 1% to 4% boron.

2. A method for manufacturing an alloy characterized by high hardness and wear resistance, said method comprising melting an alloy consisting essentially of from about 35% to 65% nickel, 15% to 25% chromium, 5% to 20% cobalt, 2% to 5% molybdenum, 1.5% to 4% titanium, 1% to 12% iron, 0.5% to 2% aluminum, and adding to said melted alloy boron in an amount to provide the alloy with a boron content of from 1% to 4%, carbon in an amount to provide the alloy with a carbon content of from about 0.7% to 2%, and silicon in an amount to provide the alloy with a silicon content of from 0.3% to 2%.

* * * * *